US005870649A

United States Patent [19]

Gotoh

[11] Patent Number: 5,870,649

[45] Date of Patent: Feb. 9, 1999

[54] IMAGE FORMING APPARATUS HAVING AN INTERMEDIATE TRANSFER BELT WITH VARIABLE MOVING SPEED IMMEDIATELY FOLLOWING TONER DEVELOPMENT

[75] Inventor: Hiroyuki Gotoh, Tokyo, Japan

[73] Assignee: Ricoh Technology Research, Inc., Tokyo, Japan

[21] Appl. No.: 863,628

[22] Filed: May 27, 1997

[30] Foreign Application Priority Data

May 27, 1997 [JP] Japan ..... 8-131665

[51] Int. Cl.[6] ..... G03G 15/01; G03G 15/16

[52] U.S. Cl. ..... 399/66; 399/223; 399/298

[58] Field of Search ..... 399/40, 298–300, 399/302, 231, 223, 66, 123, 167, 227–228

[56] References Cited

U.S. PATENT DOCUMENTS

| | | | |
|---|---|---|---|
| 4,766,463 | 8/1988 | Watanuki et al. | 399/301 |
| 4,862,214 | 8/1989 | Kasahara et al. | 399/303 |
| 5,041,878 | 8/1991 | Takai et al. | 399/302 |
| 5,303,018 | 4/1994 | Terada et al. | 399/300 |
| 5,313,259 | 5/1994 | Smith | 399/299 X |
| 5,758,226 | 5/1998 | Motohashi | 399/66 |
| 5,781,826 | 7/1998 | Inomata | 399/66 X |
| 5,790,930 | 8/1998 | Fuchiwaki | 399/302 |

FOREIGN PATENT DOCUMENTS

| | | |
|---|---|---|
| 3-211568 | 9/1991 | Japan . |
| 4-138485 | 5/1992 | Japan . |
| 5-249770 | 9/1993 | Japan . |

*Primary Examiner*—Arthur T. Grimley
*Assistant Examiner*—Quana Grainger
*Attorney, Agent, or Firm*—McDermott, Will & Emery

[57] ABSTRACT

An image forming apparatus having an image carrying member bearing an electrostatic image wherein the electrostatic image is visualized into a toner image by a developing device. The image carrying member is arranged for transferring the toner image to an intermediate transfer element while the image carrying member and intermediate transfer element are moving at a usual speed corresponding to the speed of movement of the image carrying member during toner image development. Multiple such toner images of different colors may be transferred in this manner to form multi-color images superimposed on the intermediate transfer element for subsequent transfer to a recording medium, usually paper. To increase the speed at which multi-color copies can be made, the speed of movement of the image carrying member and intermediate transfer element may be temporarily increased (a) immediately following visualization of each toner image on the image carrying member, (b) when the developing device separates from the image carrying member, and (c) after transfer of the visual image from the image carrying member to the intermediate transfer element, respectively. The speed of movement of the image carrying member and intermediate transfer element is returned to the usual speed (d) before image information is written on the image carrying member, and (e) before transfer of the multi-color image from the intermediate transfer element to the recording medium, respectively.

32 Claims, 6 Drawing Sheets

IMAGE FORMING APPARATUS HAVING AN INTERMEDIATE TRANSFER BELT WITH VARIABLE MOVING SPEED IMMEDIATELY FOLLOWING TONER DEVELOPMENT

TECHNICAL FIELD

The present invention relates to an image forming apparatus such as a copying machine, a printer, and a facsimile machine in which an electrophotographic method of image formation is utilized, and particularly to a novel image forming apparatus implementing an intermediate transfer element in an image forming operation.

BACKGROUND ART

In a color image forming apparatus as one type of image forming apparatus for obtaining a multiple color or full color image, mixed toner images of the three primary colors (yellow, magenta, cyan) are required to be formed by being superposed on a recording sheet.

In such color image forming apparatus for reproducing a multiple color image, color toners representing the three primary colors are generally used to sequentially form the respective color images which will then be superposed in turn so as to form one image of multiple colors or full-color.

As an example of such a color image forming apparatus, an image forming apparatus in which a color image can be reproduced by forming a number of toner images of respective colors and by sequentially transferring, on a one-by-one basis, each color toner image onto recording sheet as disclosed in Japanese Laid-Open Patent Application 52-73738/1977 is known.

The aforementioned color image forming apparatus includes a clamp mechanism for clamping the trailing edge of the recording sheet, so that the recording sheet is held in contact with a photoconductive element during a number of image forming operations for a number of different colors. However, the clamp mechanism is extremely complex and the image cannot be transferred to the area of the recording sheet to be clamped.

To solve the above problems, a color image forming apparatus is proposed with an intermediate transfer element, and the toner images of each of the color components are first formed on the photoconductive element in a number of operations. Then, the color toner image is formed by transferring the toner image of each of the color components superposed onto the intermediate transfer element in turn, and the color toner image is transferred onto the recording sheet.

The aforementioned intermediate transfer element is, after the carried image is transferred onto the recording sheet, prepared for the next transferring operation of the toner image by scraping off the toner remaining on the surface of the intermediate transfer element by using a cleaning blade or the like.

In the image forming apparatus as proposed above, there are a number of advantages such as increased spatial flexibility of the location for the intermediate transfer element by using a belt shaped member which is movably positioned between two rollers (a drive roller and a driven roller) as an intermediate transfer element, and reduced size of the image forming apparatus.

As a driving power source for moving the intermediate transfer element, a stepping motor or the like driving power source is often used so that the image transferring position of the intermediate transfer element may be easily controlled, being separate from a driving power source of the photoconductive element.

Furthermore, in a color image forming apparatus in which the aforementioned intermediate transfer element is used, it is required to be available for mostly all kinds of image forming sizes. Therefore, the size of the intermediate transfer element, particularly, the circumferential length corresponding to the longitudinal direction of the original document to be reproduced, often tends to be made longer.

However, when the circumferential length of the intermediate transfer element is determined according to the maximum image forming size, and if the image forming operation is executed on the basis of the original document size which is smaller than the aforementioned image forming size, the image transferring area in the image transfer element is smaller than the maximum image forming area. Therefore, the required time for executing a copying operation for obtaining a copy is made relatively long, whereas the image transferring area is relatively small, when the moving speed of the intermediate transfer element is based on the largest size of the image forming area. Furthermore, in the case of mounting a driving power source for both the photoconductive element and the intermediate transfer element, the structure of the image forming apparatus is made relatively complex and relatively large.

Presently, there is no such image forming apparatus which solves the above-mentioned problems of complexity and size.

DISCLOSURE OF THE INVENTION

The present invention has been made in view of such problems. Therefore, an advantage of the present invention is in a novel image forming apparatus having an image carrying member bearing an electrostatic image wherein the electrostatic image is visualized into a toner image by a developing device. The image carrying member is arranged for transferring the toner image to an intermediate transfer element while the image carrying member and intermediate -transfer element are moving at a usual speed corresponding to the speed of movement of the image carrying member during toner image development. Multiple such toner images of different colors may be transferred in this manner to form multi-color images superimposed on the intermediate transfer element for subsequent transfer to a recording medium, usually paper.

In accordance with one aspect of the invention, to increase the speed at which multi-color copies can be made, the speed of movement of the image carrying member and intermediate transfer element may be temporarily increased immediately following visualization of each toner image on the image carrying member.

As another aspect of the invention, the speed of movement is increased when the developing device separates from the image carrying member, and in accord with another aspect of the invention, after transfer of the visual image from the image carrying member to the intermediate transfer element.

In accordance with further aspects of the invention, the speed of movement of the image carrying member and intermediate transfer element is reduced to the usual speed before image information is written on the image carrying member, and before transfer of the multi-color image from the intermediate transfer element to the recording medium.

A further advantage of the present invention is in an abovementioned image forming apparatus in which an image bearing member and the intermediate transfer element are constructed of belts movably positioned between a driving member and a driven member.

Still a further advantage of the present invention is in an above-mentioned image forming apparatus in which the image bearing member and the intermediate transfer element are synchronously driven.

Still a further advantage of the present invention is in an above-mentioned image forming apparatus in which the image bearing member and the intermediate transfer element are driven by the same driving power source.

As a further aspect, the apparatus is arranged to detect an image carrying member, such as a magnetic or optical mark, on the intermediate transfer element, and in response, control the speed of movement of the intermediate transfer member to attain the usual speed.

BRIEF DESCRIPTION OF DRAWINGS

A more complete appreciation of the invention and many of the attendant advantages thereof will readily be obtained as the same becomes better understood by reference to the following detailed description when considered in connection with the accompanying drawings, wherein.

BEST MODE FOR CARRYING OUT THE INVENTION

The present invention is explained in detail hereinafter by an embodiment shown in the accompanied drawings.

Figure 1:
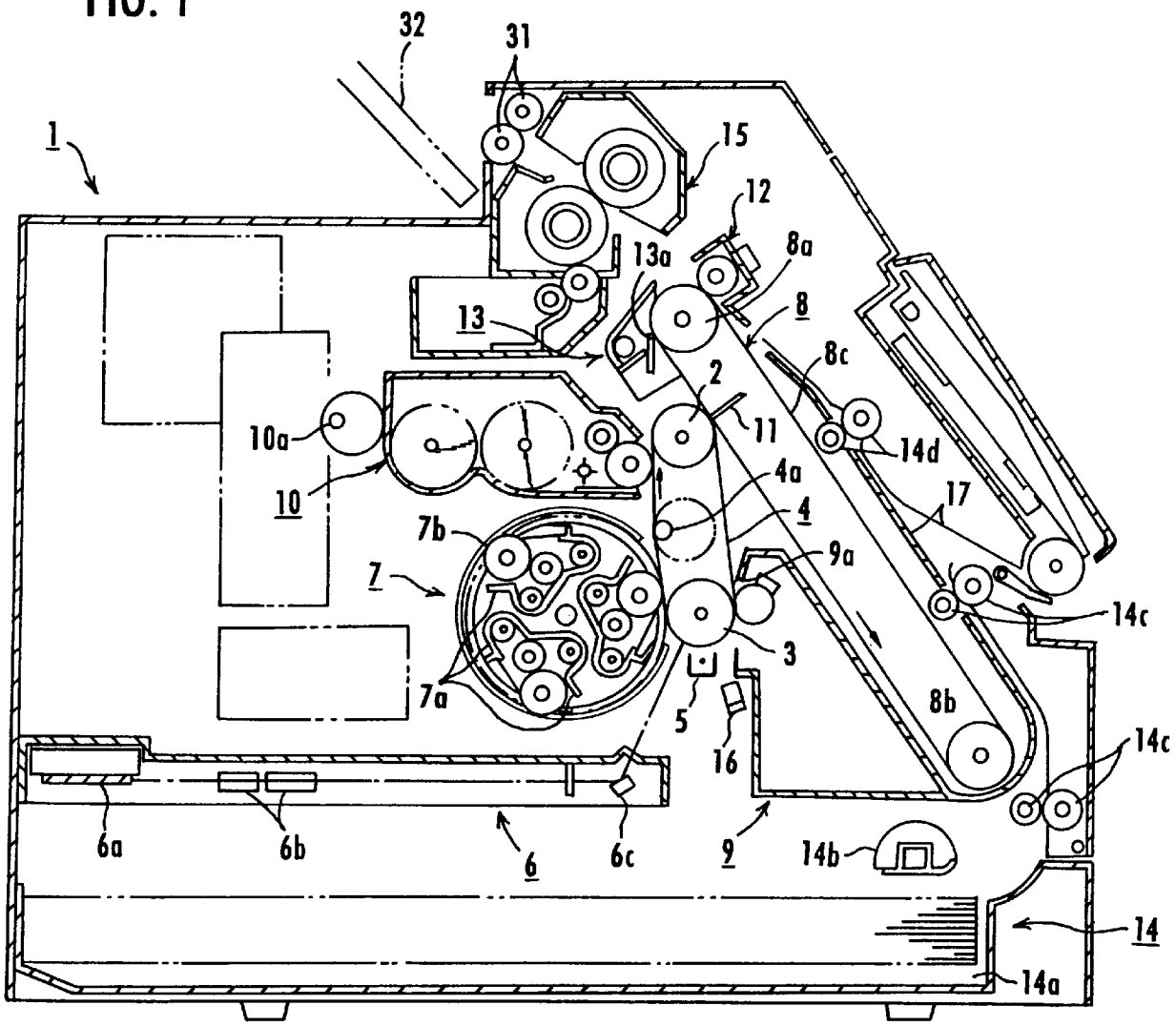
FIG. 1 is a schematic drawing showing the main structure of a color printer as one type of image forming apparatus of an embodiment according to the present invention.

FIG. 1 shows a color printer as one type of image forming apparatus of an embodiment of the present invention. The color printer forms a color image of more than one color by latent image forming and processing image development according to color image information outputted from a color image reading device (not shown) or a personal computer, and superimposing developed images.

A color printer 1 is provided with a belt like photoconductive element (hereinafter called photoconductive belt) 4 which is movably positioned between a drive pulley 2 and a driven pulley 3. The photoconductive belt 4 is movable by a drive pulley 2 in a direction indicated by an arrow. Furthermore, reference number 4*a* designates a tension roller of the photoconductive belt 4.

A charging device 5 for executing electrophotographic image forming processing, an optical writing unit 6, a developing device 7, a transferring device 8, and a cleaning unit 9 are located around the photoconductive belt 4.

Optical writing unit 6 is provided for optically writing according to an image of an original document by converting the color image information obtained from a color image reading device (not shown) or a personal computer or the like into an optical signal, and is provided with a laser light source (not shown), a polygon mirror 6*a*, a f θ (theta) lens 6*b* and a reflecting mirror 6*c*. The laser beam from the laser light source is scanned via the rotating polygon mirror 6*a* at the optical writing unit 6, and the electrostatic latent image is formed by directing the laser beam to the photoconductive belt 4 using the f θ lens 6*b* and the reflecting mirror 6*c*.

A revolver type developing device, in which the developer (for convenience, the same reference number 7*a* is used) having a selected color toner is capable of facing the photoconductive belt 4 by supporting member 7*b*, is selectively rotated. Each of the colors cyan, magenta, yellow, is in the relation of a complementary color of the color spectrum included in the color image information. The developer which contains color toner is disposed along the peripheral direction of the supporting member 7*b*, which is made of a cylindrical member in the developing device 7. A part of the peripheral wall of the supporting member 7*b* facing the photoconductive belt 4 is eliminated, and the developer is capable of supplying toner onto the electrostatic latent image on the photoconductive belt 4 by exposure thereof. The developer facing the photoconductive belt 4 is capable of supplying toner onto the photoconductive belt 4 by a driving force from a drive part (not shown), and when the toner is changed, the transmission of the drive force is released.

In addition to aforementioned revolver type developing device 7, adjacent the device 7, a black developer 10 containing black toner is disposed. The black developer 10 is capable of being attached to or detached from the photoconductive belt 10 selectively by an eccentric cam 10*a*.

The developing device 7 and the black developer 10 form a toner image by development of an electrostatic latent image carried on the photoconductive belt 4.

A transferring device 8 individually transfers toner images developed by the developing device 7 and the black developer 10 (this is called primary transfer) , and has the function of transferring the composite (superimposed) toner image (this is called secondary transfer).

The transferring device 8 has a belt 8*c*(hereinafter called transfer belt 8*c*) which is movably positioned between a drive pulley 8*a* and a driven pulley 8*b*, and is held for movement in the direction indicated by an arrow as shown in the Figure.

A transfer bias device 11 is mounted at a position facing a drive pulley 2 of the photoconductive belt 4 across the transfer belt 8*c* from the drive pulley 2, for the purpose of transferring the toner image on the photoconductive belt 4 onto the transfer belt 8*c* electrostatically.

A transfer member 12 composed of a roller is disposed on a position passing over the photoconductive belt 4 at the direction of movement of the transfer belt 8*c* across the transfer belt 8*c* from a drive pulley 8*a* facing it, and a belt cleaning unit 13 provided with a blade 13*a* contactably mounted to the transfer belt 8*c* is respectively disposed downstream of the transfer position of the photoconductive belt 4 in the direction of movement of the transfer belt 8*c*.

The transfer member 12 is used for transferring the images which have been superposed on the transfer belt 8*c* onto a paper sheet as one type of a recording medium, and the belt cleaning unit 13 removes toner from the transfer belt 8*c* by scraping.

The cleaning unit 9 is provided with a cleaning member 9*a* contactable (able to contact) to the photoconductive belt 4, and removes toner from the photoconductive belt by scraping after the developed toner image for each color respectively is transferred from the photoconductive belt 4 onto the transfer belt 8*c*.

The recording medium in which the toner image superposed onto the transfer belt 8*c* is transferred is fed out from a sheet feeding unit 14.

The sheet feeding unit 14 is provided with a sheet feeding cassette 14*a* mounted in the color printer 1, a feeding roller 14*b* which is capable of individually sending out the recording media contained inside of the sheet feeding cassette 14*a* one by one, pairs of conveying rollers 14*c* facing each other at a plurality of positions across the conveying path from other rollers 14*c* along the conveying path of the recording medium from the sheet feeding cassette 14*a* to the position of composite image transfer, and a registration roller 14*d* which sets feeding timing before the recording sheet reaches the transfer belt 8*c*.

The recording medium sent out from the sheet feeding cassette 14*a* is conveyed to the registration roller 14*d* by the pairs of conveying rollers 14*c*, being timed by the registration roller 14*d*, and the superposed toner image on the transfer belt 8*c* is transferred by sending to the position in which the transfer belt 8*c* and the transfer member 12 are facing each other.

In this embodiment, the recording media are discharged in the order of the pages discharged from the fixing unit 15, since the side of the transfer belt 8*c* of the recording medium sent out from the sheet feeding unit 14*a* is the image transferring surface.

The timing of the aforementioned cleaning unit 9 and a belt cleaning unit 13 for contacting the photoconductive belt 4 and the transfer belt 8*c* are predetermined so that toner may be scraped off by contacting the photoconductive belt and the transfer belt 8*c* at an appropriate time. The time for cleaning unit 9 to contact with the photoconductive belt 4 is after one color toner image is transferred onto the transfer belt 8*c*; the time for belt cleaning unit contacting the transfer belt 8*c* is after finishing transfer of the toner images or mono-color image onto the transfer belt 8*c*. Furthermore, reference number 16 in FIG. 1 designates an eraser composed of a discharging lamp for keeping the predetermined remaining voltage by discharging charge remaining on the photoconductive belt 4 after the cleaning process thereof is executed. Reference number 17 indicates a pair of conveying guides facing across the conveying path of the recording medium conveyed by the feeding roller 14*b* contained in the sheet feeding unit 14.

The recording medium discharged from the fixing unit 15 is discharged towards a discharging tray 32 disposed behind the fixing unit 15.

Figure 2:
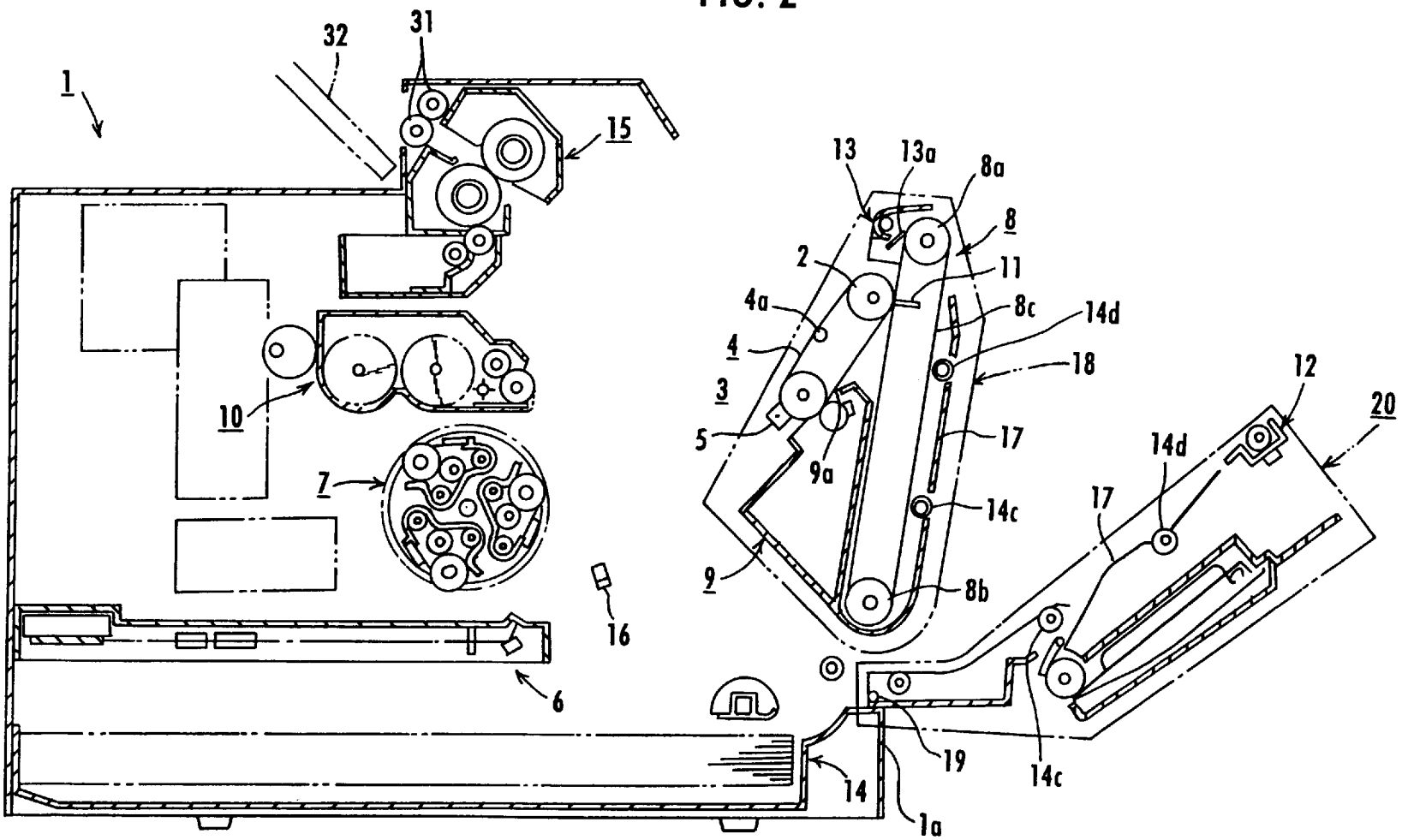
FIG. 2 is a schematic diagram explaining one of the states of the color printer shown in FIG. 1.

The color printer 1 as shown in FIG. 1 is provided with the construction as shown in FIG. 2 for convenience.

The photoconductive belt 4, the transfer belt 8*c* and the belt cleaning unit 13, one of the pair of the conveying rollers pair 14*c*, and one part of the conveying guide 17 are contained in a unit 18 movably positioned around a shaft of a driven pulley 8*b* of the transfer belt 8*c*. Another part of the conveying rollers 14*d* and another part of the conveying guides 17 in which the recording medium fed from the sheet feeding cassette 14*a* faces are contained in a printer front frame 20 movably supported against a main body frame 1*a* of the printer 1 by a shaft 19 positioned adjacent the sheet feeding cassette 14*a*.

The unit 18 and the printer front frame 20 are movably positioned between a position in which the photoconductive belt 4 is able to face the developing unit 7 and the black developer 10. The sheet conveying path is able to be constructed as shown in FIG. 1, the position in which the aforementioned facing relation of each of the components and the conveying path are releasable is as shown in FIG. 2. Maintenance and exchanging each of the members, and removal of any recording medium jammed along the conveying path may thus be performed as shown in FIG. 2.

Figure 3:
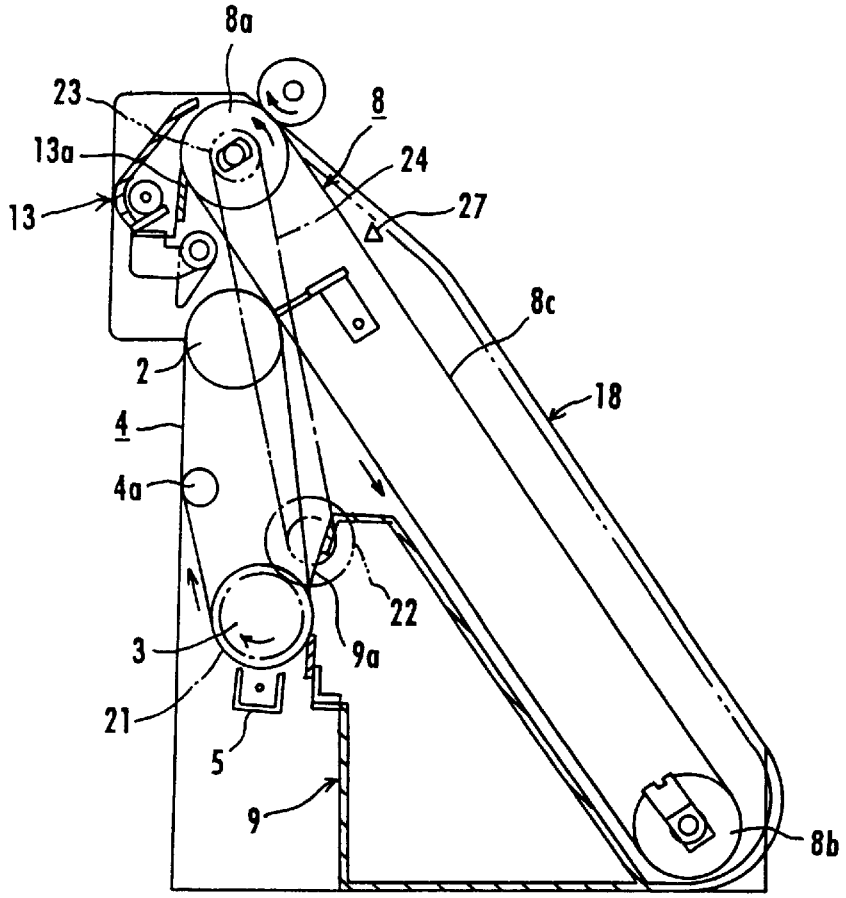
FIG. 3 is a partly schematic diagram explaining a state of an image carrying member and an intermediate transfer element used for a color printer shown in FIG. 1.

FIG. 3 shows a construction of each of the members contained in the aforementioned unit 18. The photoconductive belt 4 and the transfer belt 8*c* are able to be driven by a stepping motor as a common driving power source (not shown) in the Figure.

Transmission of the driving force between the photoconductive belt 4 and the transfer belt 8*c* is done with a gear 21 for driven pulley 3 of the photoconductive belt 4 mounted on a same shaft as the driven pulley 3, a gear pulley 22 engaged with the gear 21, a timing belt 24 movably positioned between the gear pulley 22 and a gear 23 for a drive pulley mounted on the same shaft as a drive pulley 8*a* of the transfer belt 8*c*. Both of the belts 4 and 8*c* are driven in synchronization with each other.

A recognition mark (not shown) is on the transfer belt 8*c* to be detected by a mark sensor 27 disposed adjacent the transfer belt 8*c*. The recognition mark represents a start of timing of each process such as the image writing process or the like for the next image formation detected by the mark sensor 27.

The aforementioned transfer belt 8*c* is mounted for movement at a speed changeable according to the image forming size. The construction for the purpose of the aforementioned feature is hereinafter explained.

Figure 4:
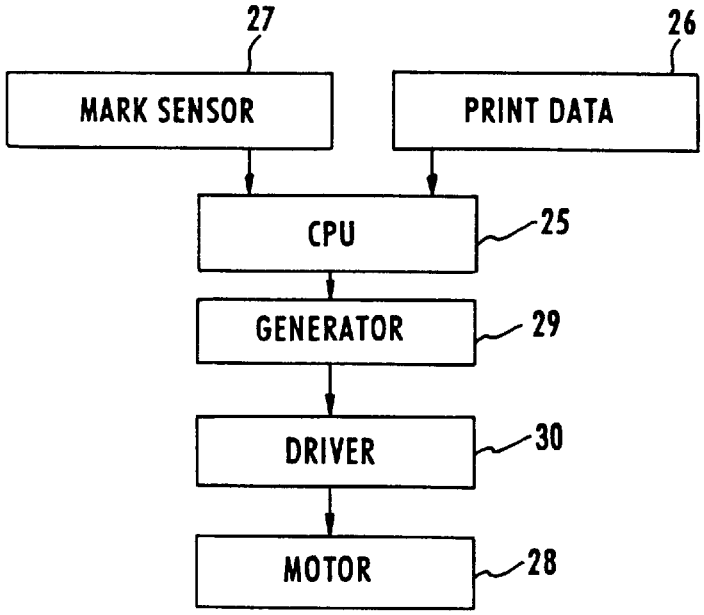
FIG. 4 is a block diagram explaining the construction of a controller section used for a color printer shown in FIG. 1.

FIG. 4 is a block diagram explaining the construction of the controller for controlling the moving speed of the transfer belt 8*c*, and in the Figure, a controller 25 is provided with a microcomputer as a main part (in FIG. 4, indicated as CPU) . There are connected a copying operational part 26 (not shown but indicated as PRINT DATA in FIG. 4) for indicating size data and color modes for copy, and the mark sensor 27 to the inputting part thereof. Furthermore, there are connected a driver 30 via a pulse generator 29 (in FIG. 4, indicated as GENERATOR) for driving a stepping motor 28 (in FIG. 4, indicated as MOTOR) as a driving power source for the photoconductive belt 4 and the transfer belt 8*c* at the outputting part.

In the controller part 25, the circumferential length of the transfer belt 8*c* as shown in FIG. 1 through FIG. 3 is more than 420 mm which is the length available for securing the image forming area of the A3 size. Hence, in the case of using an image forming area less than A3 size, particularly, A4 size which is half the A3 size in the working circumferential length of the transfer belt 8*c* required for image formation, the moving speed of the transfer belt 8*c* after finishing an image forming operation at the image forming area of small size is brought to be faster than before.

The controller 25 returns the moving speed of the transfer belt 8*c* into its usual image forming speed, at the time of executing the next image writing to the photoconductive belt 4, and at the time of executing transfer from the transfer belt 8*c* onto the recording medium. Therefore, at the controller 25, frequency control to the stepping motor as a driving power source is executed for speed control on the basis of each timing mentioned later.

Figure 5:
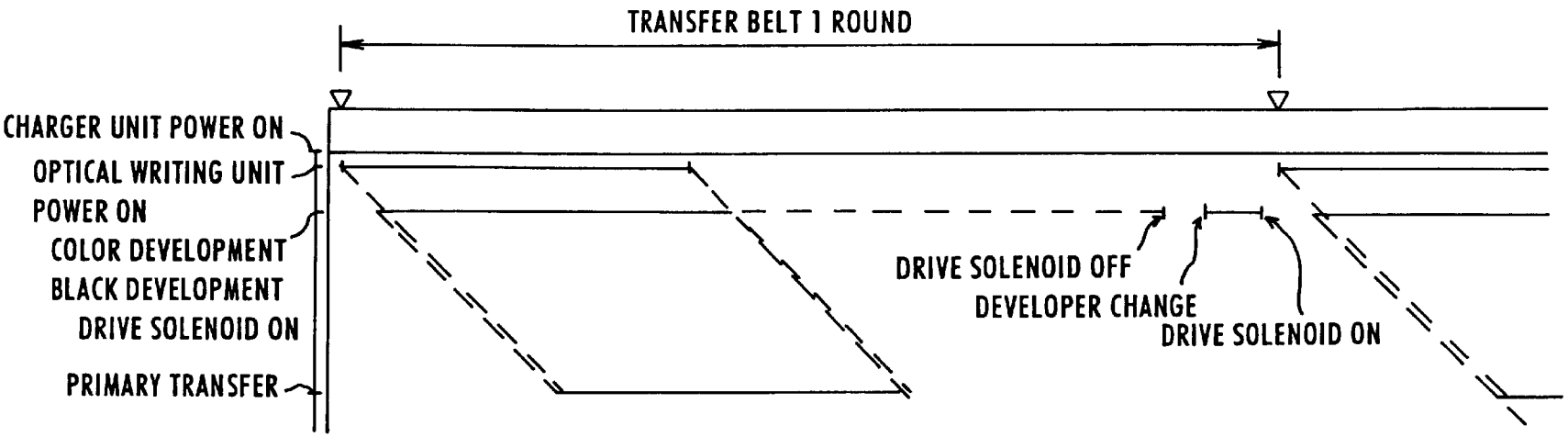
FIG. 5 is a timing chart explaining the image forming timing of a conventional color printer.

FIG. 5 is a timing chart explaining the timing required for primary transfer of one color image, when speed control is not executed.

In FIG. 5, image writing to the photoconductive belt 4, developing, and transfer of toner image from the photoconductive belt 4 onto the transfer belt 8*c* are executed as the transfer belt 8*c* turns around in one cycle. Then, changing the operation of the developer at the developing unit 7 for developing the next color image is executed after the primary transfer is finished.

At the time of changing the developer, transmission of drive force to a drive part of the developer is released, a supporting member of the developer 7 (see FIG. 1) is rotated when the developer 7 is used, and again transmission of drive force to the developer is started after the developer is changed. Furthermore, in FIG. 5, regarding the changing of the developer, a solenoid for connecting/disconnecting the drive force to the developer is shown. When the black developer 10 is used, connecting/disconnecting control of the drive force is executed according to the motion of rotating drive of an eccentric cam 10*a* for attaching/detaching motion of the black developer 10 to the photoconductive belt 4.

The time for primary transferring of toner image at the usual image forming speed, multiplied by the number of times of primary transferring, corresponds to the time for repeating the primary transfer and finishing superimposing of a plurality of color images onto the transfer belt 8*c* without executing speed control of the transfer belt 8*c*, as shown in FIG. 5.

Figure 6:
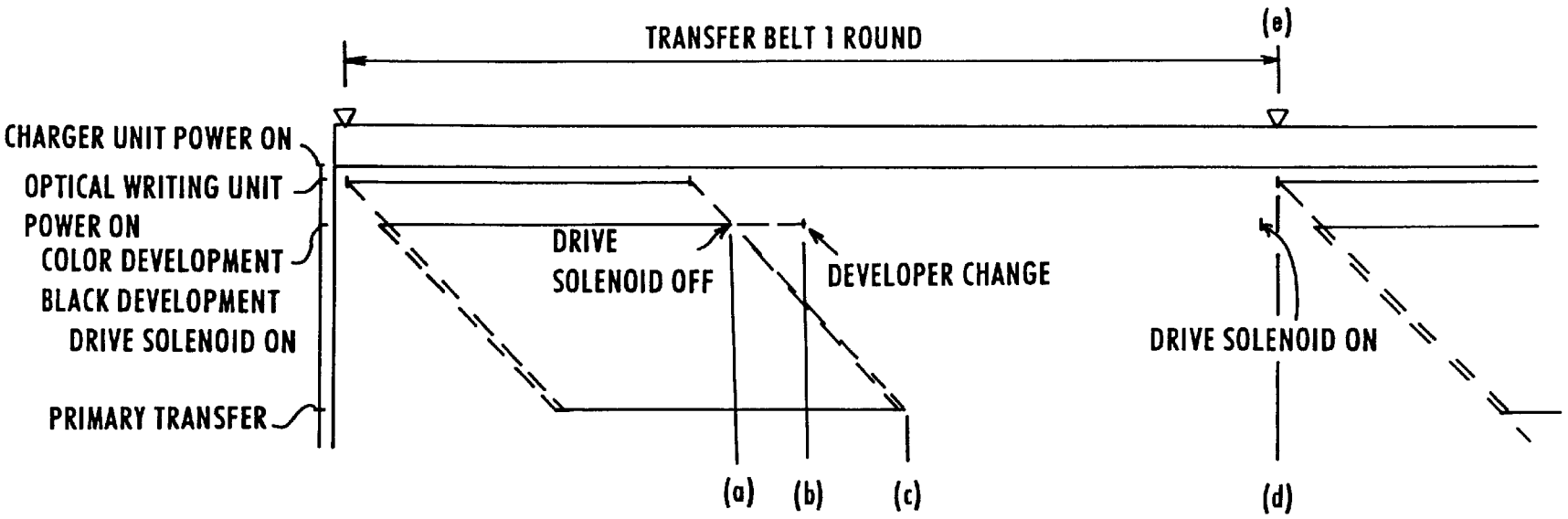
FIG. 6 is a timing chart explaining a function of the controller section shown in FIG. 4.

In this embodiment, as shown in FIG. 6, the following speed control is executed at each of the time points. The first time point is when image development for obtaining one color toner image is finished (indicated by "a" in FIG. 6). The second time point is when the developer of the developing device 7 is changed or the black developer 10 is separated from the photoconductive belt 4 (indicated by "b" in FIG. 6). The third time point is when the primary transfer for a toner image is finished (indicated by "c" in FIG. 6). The fourth time point is when the image writing process for the next image forming is started after the primary transfer is finished (indicated by "d" in FIG. 6). The fifth time point is when the recognition portion of the transfer belt 8*c* is detected by the mark sensor 27 (indicated by "e" in FIG. 6). The sixth time point is when the secondary transfer in which the superimposed toner image is transferred onto the recording medium is started after the repeated primary transfers are finished (not shown).

At the times of reference characters, "a", "b" and "c", in FIG. 6, the moving speed of the transfer belt 8*c* is made faster than the usual image forming speed, and at the times of the reference characters "d", "e" and un-figured time in which the secondary transfer is started, the faster moving speed is changed back to the usual image forming speed. The speed change is executed in a combination of any one of the times "a", "b", "c" capable of increasing the speed as mentioned above and the time of returning to the usual image forming speed.

In the controller 25, when selecting the case of using the image forming area smaller than the size thereof corresponding to the circumferential length of the transfer belt 8*c* as print data, the speed increasing operation is executed by calculating the times of the above mentioned "a", "b" or "c", on the basis of the timing mark detected by the mark sensor 27. Further, the moving speed of the transfer belt 8*c* is changed into the usual image forming speed by determining the times of the image writing process (reference character "d") and the secondary transferring process, on the basis of detection of the timing recognition mark by the mark sensor 27.

When the time at which the mark sensor 27 has detected (indicated by the reference character "e" in FIG. 6) the time of speed changing, deviation of the image, due to slip of the transfer belt 8*c* at a time of starting the image writing process or inertia of the driving power source in each of the images provided for the primary transfer, is eliminated.

Since this embodiment of the present invention is constructed as mentioned above, the moving speed of the transfer belt 8*c* is made faster than the usual image forming speed at one of any times "a", "b", "c" in FIG. 6, and further, returns to the usual image forming speed on the basis of detecting the recognition mark of the transfer belt 8*c* by the mark sensor 27.

Figure 7:
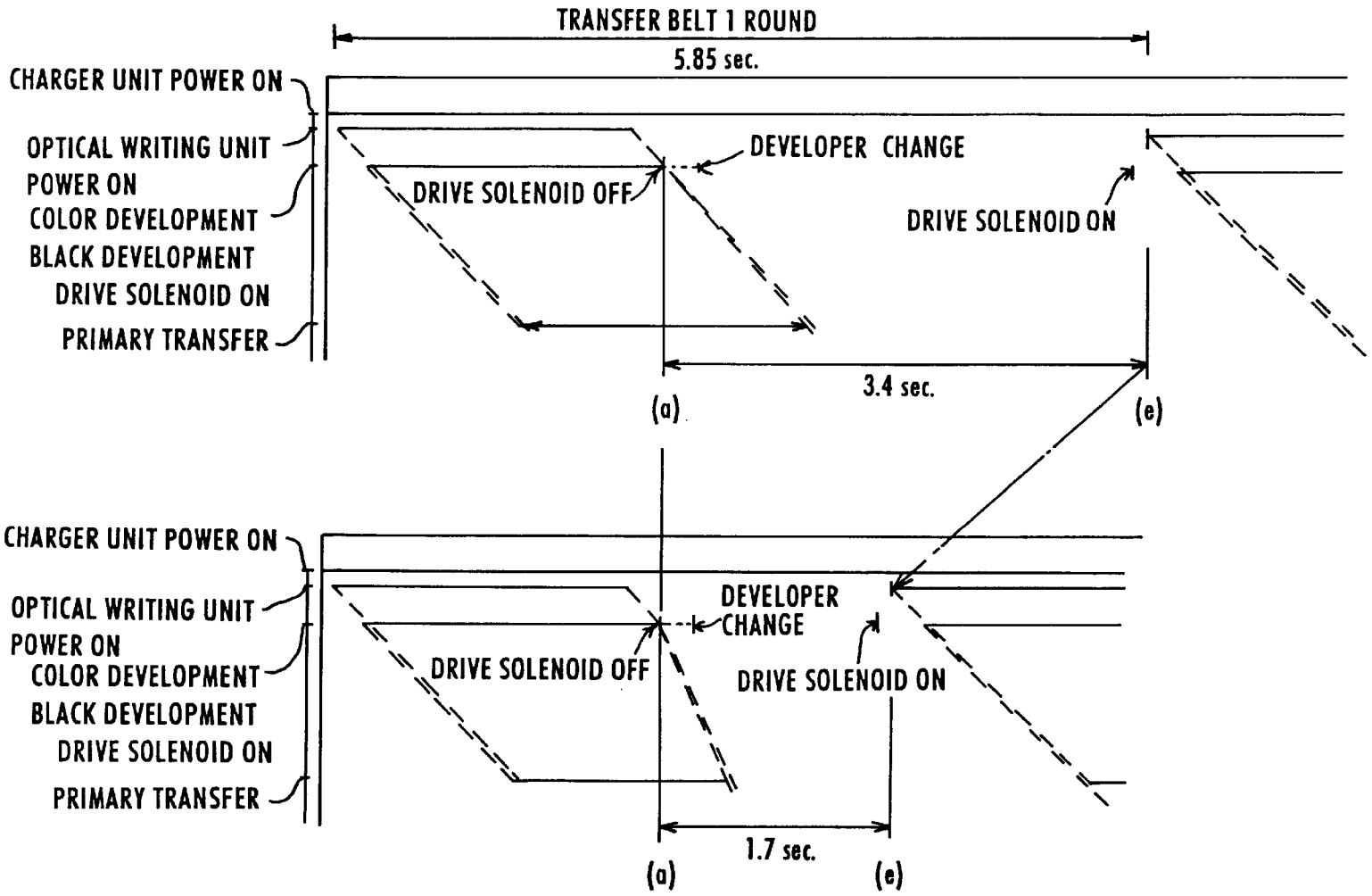
FIG. 7 is a timing chart explaining image forming timing performed by the controller section shown in FIG. 4.

In FIG. 7, the transfer belt 8*c* of a circumferential length of 562 mm is used for forming an image of A3 size, moving the transfer belt 8*c* at the speed of 96 mm/sec as the usual image forming speed. Further, the time difference between the case of the speed thereof and another case of the speed controlled as mentioned above, is shown.

The speedup process and changing speed of the transfer belt 8*c* back to the usual image forming speed are executed according to the print data as shown in FIG. 4, when A4 size (circumferential length =210) having shorter circumferential length than the A3 size is selected, at the time point combination of the reference characters "a" and "d" in FIG. 7.

The moving speed of the transfer belt 8*c* is changed by calculating the time indicated by the reference character "d" on the basis of the time at which the recognition mark of the transfer belt 8*c* is detected by the mark sensor 27. The moving speed of the transfer belt 8*c* this may be made faster by two times compared to the speed of the A3 size at the time indicated by the reference character "a" in FIG. 6, and returned to the usual image forming speed.

As shown in FIG. 7, whereas the time required between the aforementioned reference characters "a" and "d" is 3.4 sec., in the case of moving the transfer belt 8*c* at the usual image forming speed for A3 size, 1.7 sec., or half of the speed ratio of A3 size for the required time, is obtained in this embodiment. Therefore, 5.1 sec. is able to be reduced in amount that is a multiple of the number of repeating times (three) , because the primary transfer process is repeated for three times for the full color copy.

Furthermore, the stepping motor is used as the same driving power source for the photoconductive belt 4 and the transfer belt 8*c* in this embodiment; however, a servo motor which is capable of controlling the speed by current controlling is also able to be used without limitation thereof.

Still further, the present invention is not limited to the belt like photoconductive element or the intermediate transfer belt, but also the drum shaped photoconductive element or the intermediate transfer element capable of considering length in a circumferential direction instead of the circumferential length of the belt used for executing speed control.

The controller of this invention may be conveniently implemented using a conventional general purpose digital computer or a microprocessor programmed according to the teachings of the present specification, as will be apparent to those skilled in the computer art. Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art.

Obviously, numerous modifications and variations of the present invention are possible in light of the above teachings. It is therefore to be understood that within the scope of the appended claims, the invention may be practiced otherwise than as specifically described herein.

What is claimed is:

1. An image forming apparatus, comprising:

an image carrying member for carrying toner images corresponding to image information made by a developing device which visualizes an electrostatic image with toner;

a recording medium source; an intermediate transfer element, onto which said toner images are to be transferred from said image carrying member while said image carrying member and said intermediate transfer element are being moved at a usual speed, said toner images being superimposed in turn on said intermediate transfer element by repeating a transferring operation from said image carrying member to said intermediate transfer element for each of said images newly formed on said image carrying member; and a transfer element positioned between said image carrying member and said recording medium source for transferring said superimposed toner images onto a recording medium;

wherein immediately following toner image visualization on said image carrying member, a speed of movement of said image carrying member and said intermediate transfer element is increased to a speed greater than said usual speed.

2. The image forming apparatus according to claim 1, wherein the speed of movement of the image carrying member and intermediate transfer element is controlled to return to said usual speed, before image information is written onto the image carrying member, when image information of a different color is to be next formed on the image carrying member.

3. The image forming apparatus according to claim 1, wherein the speed of movement of the image carrying member and intermediate transfer element is returned to said usual speed before a superimposed visual image is transferred from the intermediate transfer element to the recording medium.

4. The image forming apparatus according to claim 1, wherein the intermediate transfer element and the image carrying member are rotated synchronously to each other by a common drive power source.

5. The image forming apparatus according to claim 1, wherein said image carrying member and said intermediate transfer element each are formed of a belt-shaped member.

6. The image forming apparatus according to claim 1, wherein the image carrying member and intermediate transfer element are controlled to move at a speed greater than said usual speed after toner image visualization on, and separation of said developing device from, said image carrying member.

7. The image forming apparatus according to claim 1, wherein the speed of movement of the image carrying member and intermediate transfer element is returned to said usual speed prior to writing of image information onto the image carrying member when image information of a different color is to be next formed on the image carrying member.

8. The image forming apparatus according to claim 6, wherein the speed of movement of the image carrying member and intermediate transfer element is returned to said usual speed before a superimposed visual image on the intermediate transfer element is transferred to the recording medium, when no image information of a different color is to be next formed on the image carrying member.

9. The image forming apparatus according to claim 6, wherein the intermediate transfer element and image carrying member are rotated in synchronism with each other by a common drive power source.

10. The image forming apparatus according to claim 6, wherein the intermediate transfer element and the image carrying member are each composed of a belt-shaped member.

11. An image forming apparatus, comprising:

an image carrying member for carrying toner images made by a developing device which visualizes an electrostatic image corresponding to image information with toner;

a recording medium source;

an intermediate transfer element, onto which said toner images are to be transferred from said image carrying member while said image carrying member and said intermediate transfer element are being moved at a usual speed, said toner images being superimposed in turn on said intermediate transfer element by repeating a transferring operation from said image carrying member to said intermediate transfer element for each of said toner images newly formed on said image carrying member; and a transfer element positioned between said image carrying member and said recording medium source for transferring said superimposed toner images onto a recording medium;

wherein a speed of movement of said image carrying member and said intermediate transfer element is controlled to be faster than said usual speed after transfer of the visual image from the image carrying member to the intermediate transfer element is completed.

12. The image forming apparatus according to claim 11, wherein the speed of movement of the image carrying member and intermediate transfer element is returned to said usual speed before image information is written onto the image carrying member when image information of a different color is to be next formed onto the image carrying member.

13. The image forming apparatus according to claim 11, wherein the speed of movement of the image carrying member and intermediate transfer element is returned to said usual speed before a superimposed image is transferred from the intermediate transfer element to the recording medium.

14. The image forming apparatus according to claim 11, wherein the intermediate transfer element and the image carrying member are driven in synchronism with each other.

15. The image forming apparatus according to claim 11, wherein the intermediate transfer element and the image carrying member are driven by a common drive power source.

16. The image forming apparatus according to claim 11, wherein the intermediate transfer element and image carrying member each are composed of a belt-shaped member.

17. An image forming method, comprising the steps of:

producing on an image carrying member an electrostatic image corresponding to image data written thereto;

visualizing the electrostatic image with toner;

transferring the toner image from the image carrying member to an intermediate transfer element while controlling speed of movement of the image carrying member and intermediate transfer element at a usual speed;

repeating the preceding steps to superimpose multiple images on the intermediate transfer element;

transferring the superimposed images from the intermediate transfer element to a recording medium; and increasing the speed of movement of the image carrying member and intermediate transfer element immediately following toner image visualization on the image carrying member.

18. The method of claim 17, including driving the image carrying member and intermediate transfer element synchronously to each other.

19. The method of claim 17, including controlling the speed of movement of the image carrying member and intermediate transfer element to return to said usual speed, before image information is written onto the image carrying member, when image information of a different color is to be next formed on the image carrying member.

20. The method of claim 17, including reducing the speed of movement of the image carrying member and intermediate transfer element to said usual speed before a superimposed visual image is transferred from the intermediate transfer element to the recording medium.

21. The method of claim 17, including controlling the image carrying member and intermediate transfer element to move at a speed greater than the usual speed after toner image visualization on, and upon separation of a developing device from, said image carrying member.

22. The method of claim 17, including controlling the speed of movement of the image carrying member and intermediate transfer element to return to the usual speed prior to writing of image information onto the image carrying member when image information of a different color is to be next formed on the image carrying member.

23. The method of claim 21, including reducing the speed of movement of the image carrying member and intermediate transfer element to said usual speed before a superimposed visual image on the intermediate transfer element is transferred to the recording medium, when no image information of a different color is to be next formed on the image carrying member.

24. An image forming method, comprising the steps of:

producing on an image carrying member an electrostatic image corresponding to image data written thereto;

visualizing the electrostatic image with toner;

transferring the toner image from the image carrying member to an intermediate transfer element while controlling speed of movement of the image carrying member and intermediate transfer element at a usual speed;

repeating the preceding steps to superimpose multiple images on the intermediate transfer element;

transferring the superimposed images from the intermediate transfer element to a recording medium; and increasing the speed of movement of the image carrying member and intermediate transfer element after transfer of the visual image from the image carrying member to the intermediate transfer element is completed.

25. The method of claim 24, including reducing the speed of movement of the image carrying member and intermediate transfer element to said usual speed before image information is written onto said image carrying member when image information of a different color is next to be formed onto the image carrying member.

26. The method of claim 24, including reducing the speed of movement of the image carrying member and intermediate transfer element to said usual speed before a superimposed image is transferred from the intermediate transfer element to the recording medium.

27. The method of claim 24, including maintaining the speed of movement of the image carrying member and intermediate transfer element in synchronism with each other.

28. The image forming apparatus according to claim 1, further comprising:

a recognition member formed on said intermediate transfer element; and a position detector for detecting said recognition member;

wherein the speed of the intermediate transfer element is controlled to attain said usual speed upon detection of said recognition member by said position detector.

29. The image forming apparatus according to claim 11, further comprising:

a recognition member formed on said intermediate transfer element; and a position detector for detecting said recognition member;

wherein the speed of the intermediate transfer element is controlled to attain said usual speed upon detection of said recognition member by said position detector.

30. The method of claim 17, including the further steps of:

detecting a recognition member on said intermediate transfer element; and in response controlling the speed of movement of said intermediate transfer element to attain said usual speed.

31. The method of claim 24, including the further steps of:

detecting a recognition member on said intermediate transfer element; and in response controlling the speed of movement of said intermediate transfer element to attain said usual speed.

32. An image forming apparatus, comprising:

an image carrying member for carrying a toner images made by developing device which visualizes an electrostatic image corresponding to image information with toner;

a recording medium source;

an intermediate transfer element, onto which said toner images are to be transferred from said image carrying member while said image carrying member and said intermediate transfer element are being moved at a usual speed, said toner images being superimposed in turn on said intermediate transfer element by repeating a transferring operation from said image carrying member to said intermediate transfer element for each of said images newly formed on said image carrying member; and a transfer element for transferring said superimposed toner images onto a recording medium;

wherein a speed of movement of said image carrying member and said intermediate transfer element is controlled to be faster than said usual speed after transfer of the visual image from the image carrying member to the intermediate transfer element is completed.

* * * * *